United States Patent [19]

Hirt et al.

[11] Patent Number: 4,833,990

[45] Date of Patent: May 30, 1989

[54] PRINTING PRESS FOR MODIFYING HYDROPHOBIC AND HYDROPHILIC AREAS OF A PRINTING IMAGE CARRIER

[75] Inventors: Alfred Hirt, Munich; Hartmut Fuhrmann, Karlsfeld, both of Fed. Rep. of Germany

[73] Assignee: Man Technologie GmbH, Munich, Fed. Rep. of Germany

[21] Appl. No.: 103,428

[22] Filed: Sep. 30, 1987

[30] Foreign Application Priority Data

Oct. 3, 1986 [DE] Fed. Rep. of Germany ..... 3633758

[51] Int. Cl.[4] ..... B41C 1/10

[52] U.S. Cl. ..... 101/130; 101/467; 101/478

[58] Field of Search ..... 101/1, 467, 426, 130

[56] References Cited

U.S. PATENT DOCUMENTS

| | | | |
|---|---|---|---|
| 3,358,081 | 12/1967 | Young | 178/6.6 |
| 3,406,060 | 10/1968 | Schlein | 96/1 |
| 3,530,441 | 9/1970 | Ovshinsky | 340/173 |
| 3,550,155 | 12/1970 | DeRosa | 346/74 |
| 3,643,014 | 2/1972 | Rosenberg | 178/6.6 A |
| 3,651,281 | 3/1972 | Becker | 179/100.2 CH |
| 3,651,488 | 3/1972 | Amodei | 340/173 CC |
| 3,654,864 | 4/1972 | Ovshinsky | 101/426 |
| 3,659,936 | 5/1972 | Klose | 355/3 |
| 3,698,006 | 10/1972 | Ovshinsky | 46/74 ES |
| 3,832,718 | 8/1974 | Berkowitz | 346/74 MT |
| 3,951,533 | 4/1976 | Bergen | 353/31 |

*Primary Examiner*—Clifford D. Crowder

*Attorney, Agent, or Firm*—Scully, Scott, Murphy & Presser

[57] ABSTRACT

For modifying the printing image on a printing image carrier within a printing press the printing image carrier is in the form of a material with ferroelectric properties. Electrodes with or without heat sources are used to delete and write matter on the printing image carrier by polarizing and depolarizing the respective parts of the printing image carrier or the ferroelectric material. The depolarized material is hydrophobic so that it accepts the printing ink whereas the polarized parts are hydrophilic and accept water.

14 Claims, 1 Drawing Sheet

PRINTING PRESS FOR MODIFYING HYDROPHOBIC AND HYDROPHILIC AREAS OF A PRINTING IMAGE CARRIER

BACKGROUND OF THE INVENTION

The invention relates to a printing press comprising means for modifying hydrophobic and hydrophilic areas of the printing image carrier of the press.

In lithographic or surface printing the carrier for the printing image employed is characterized by the fact that its surface properties differ between printing and non-printing areas. In lithography and more especially in the case of offset printing with dampening systems the water accepting or hydrophilic areas and the water repelling or hydrophobic areas are produced which after dampening and inking with oleophilic printing ink are capable of printing on the material to be printed via a blanket cylinder.

In conventional lithographic printing methods as used so far the printing image carrier is in the form of a thin plate, which is prepared outside the press in a plurality of photolithographic method steps. Prior to printing the plate has to be mounted on the plate cylinder, adjusted and run in. The result is that the press is idle for long periods and waste is produced during set-up of the press for a new run. Any modification of the image to be printed on the paper always entails changing the plate.

Accordingly in the past attempts have been made to develop methods for directly producing an image on the printing image carrier in the printing press. One printing image carrier proposed (see the European Pat. No. 101,266) comprises a hydrophilic and a hydrophobic layer able to be applied in the printing press. A laser beam responsive to encoded printing information is able to remove parts of the hydrophobic layer corresponding to the image to be printing. Every time the image is changed the hydrophobic layer is reformed in the press.

Furthermore systems have been proposed in which the hydrophilisation of the surface of the printing image carrier is produced by electrical charges (see German Pat. No. 3,311,237), by activation of photochromes or of thermochromes (see U.S. Pat. No. 3,422,759) or by a structural modification of semiconducting glasses (see German Pat. No. (2,111,561).

These previous methods require either the precise observation of very tight parameters or a large amount of energy for modifying the printing image carrier. Furthermore, there are doubts as to whether such methods would make it possible to carry out multiple modification of the printing image carrier and whether the printing image carrier would be suitable for long runs.

SHORT SUMMARY OF THE INVENTION

Accordingly one object of the invention is to develop a method for the manufacture of a printing image carrier in which wettability properties of the printing image carrier may be selectively changed over between hydrophilic and hydrophobic states in a simple manner.

A further aim of the invention is to make such a change-over in properties more rapid and capable of being repeated a maximum number of times.

A still further object of the invention is to ensure that once the properties have been changed over they do not become changed in the course of a printing run unless such change is desired.

In order to achieve these or other objects of the invention as indicated in the specification and claims, the printing image carrier comprises a material with ferroelectric properties which may be polarized and depolarized locally by means forming part of the printing press.

Because of their molecular structure, ferroelectric materials possess a permanent electrical dipole moment which aligns itself in the direction of an externally applied field in which the material is placed. Macroscopically this property manifests itself as an electrical polarization, which may only be modified by the application of a suitably large opposite field in the direction thereof. In a manner analogous to ferromagnetic materials, there is a so-called Curie point as a maximum temperature at which owing to thermic motion the ferroelectric properties disappear and an externally non-polar element comes into existence.

The hydrophilisation or re-hydrophilisation of a printing image carrier with ferroelectric properties thus takes place through a polarizing and depolarizing mechanism, which may be caused to occur reversibly within the printing image carrier an unlimited number of times.

A further advantage of the invention is that the wetting effect is not based upon monomolecular surface properties but rather on wide-ranging electrostatic forces of attraction. Thin dielectric dirt or ink layers do therefore not cause any difficulty in the reversing operation, since the electric field strength is only influenced thereby to an insubstantial extent.

The printing image carrier may therefore consist of a thin foil or a layer on a printing image carrier base, which is applied by vapor coating or by some other known method to the carrier. The material may suitably be a ferroelectric material, which is in the form of a foil or a layer. For applications such as flexographic printing in which soft printing image carriers are required a compound material pervaded by ferroelectric microcrystals may be used. In this case it is also possible to use a printing image carrier which comprises a ferroelectric layer on which a thin layer of hydrophobic material is applied.

In accordance with one possible form of the invention, for the modification of the polarisation zones of the printing image carrier there is a pair of electrodes and a source of heat, which are operated by means of an information transmitting unit. The information transmitting unit may comprise a conventional system such as an electrical full page transmitting paging system, a full page assembly system, a facsimile transmitting system, a computer control, microprocessors and the like which produce output signals for operation of the heat source and the pair of electrodes, in accordance with the image information.

Various designs of the pair of electrodes are possible. In a simple construction there is a linear electrode or one or more dot electrodes cooperating with the printing image carrier base acting as the counter-electrode. Such pairs of electrodes are used to polarize the printing image carrier line by line or dot by dot. The respective heat source, which is used for depolarization, is designed in accordance with the type of polarizing operation. The heat sources may be lasers such as infrared lasers, concentrated light sources, heated pins and the like. A dot heat source is used in conjunction with a linear electrode, that is to say previous printing images are deleted with the electrode. The dot heat source produces a new printing image. However the reverse procedure is possible, that is to say a procedure in which deletion takes place with a linear heat source and modification is performed with a dot electrode.

If the heating effect required for depolarisation is undesired within the press, it is possible for the depolarization to be performed by the action of a major alternating electric field.

A further possible way of performing modification without a source of heat is to use one electrode for producing an electric field which polarizes the ferroelectric film of the printing image carrier and a second electrode able to produce a corresponding field for repolarizing the ferroelectric layer. This electrode is a dot electrode and serves to mark the printing image pattern. This method takes advantage of the property that in zones with different polarization the outwardly effective free interface energy is so altered that the wetting properties of the ferroelectric material relevant for polar solvents (f. i. water) and non-polar solvents (f. i. printing ink) are drastically changed. It is more especially the case that at the so-called domain boundaries, at which there is a reversal of polarity, such strong electrical fields are produced that polar liquids are directly attracted. Accordingly repolarization causes hydrophilic zones to come into existence following the domain walls. This method makes it possible to print with an extremely high degree of resolution.

In accordance with a further form of the invention two pin electrodes are utilized of which one serves for selective "deletion" and the other for selective "writing". This makes it possible to perform a partial modification of the printing image on the printing image carrier, something that is also possible with a dot electrode in connection with a dot heat source.

Working examples of the invention will now be described in more detail whose figures are diagrammatic.

LIST OF THE SEVERAL VIEWS OF THE DRAWINGS

DETAILED ACCOUNT OF WORKING EXAMPLES OF THE INVENTION

Figure 1:
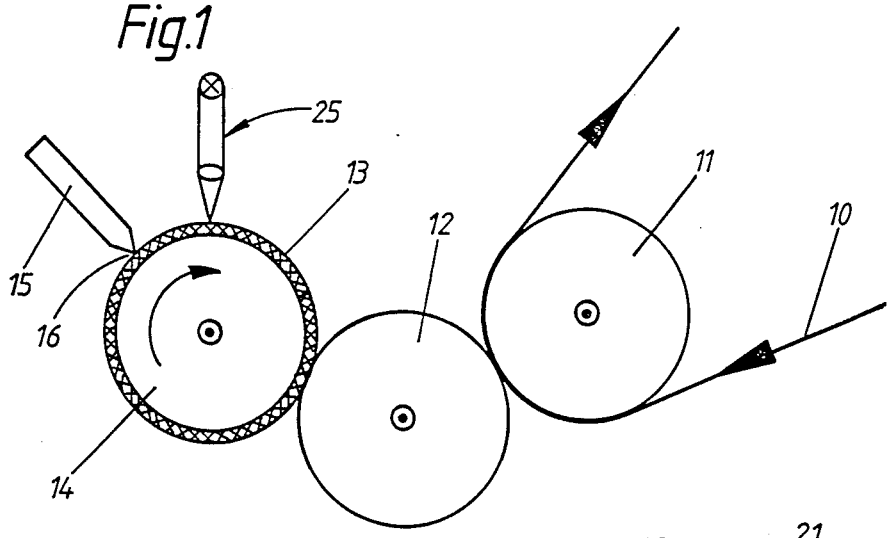
FIG. 1 shows a first working embodiment of the invention.

FIG. 1 shows the ink transfer cylinders of a surface printing or offset litho press in cross section. The paper 10 to be printed is fed between an impression cylinder 11 and a blanket cylinder 12 so that it takes up the ink on the blanket of the cylinder 12. The ink which is distributed to represent lettering or graphic artwork is supplied from a printing image carrier 13 to the blanket cylinder 12. The printing image carrier 13 is located on a printing image carrier cylinder 14 which is also able to rotate. The printing image carrier 13 consists of a ferroelectric material as for instance barium titanate which is applied as a coating to the printing image carrier cylinder 14. However it is also possible to apply the ferroelectric layer to a foil and to mount this coated foil as a printing image carrier or printing plate on the printing image carrier cylinder 14. The printing image carrier may also be produced in the form of a foil of ferroelectric material. Another possibility of producing a printing image carrier of ferroelectric material is the use of a basic material such as a hybrid material with hydrophilic properties, as for example soft plastic mats in which the ferroelectric microcrystallites are included. Such mats are particularly suited for use as printing image carriers for flexographic printing.

The wettability of a ferroelectric material for polar and non-polar liquids is determined by the polarization of the ferroelectric material. By the application of a suitably strong electric field and the selection of the field properties the polarization of the ferroelectric material may be aligned. Depolarization may also be effected by heating the ferroelectric material above the Curie point. The Curie point of barium titanate is 120° C.

As will be seen from FIG. 1 there is a flat electrode 15 with a linear tip 16 which cooperates with the printing image carrier cylinder 14 in the form of a counter electrode.

Figure 2:
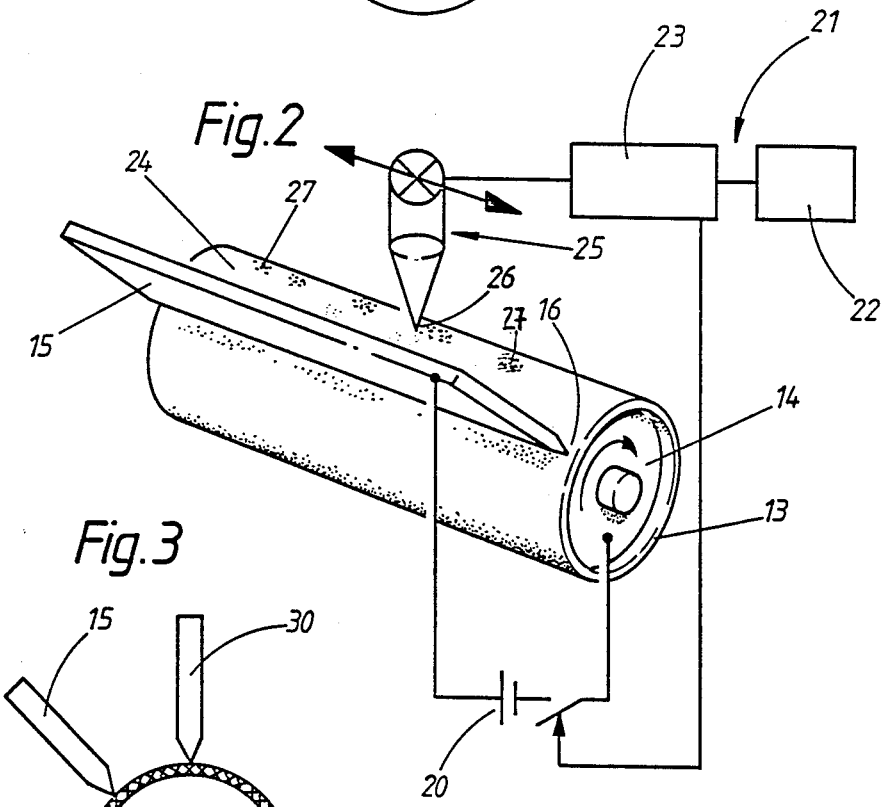
FIG. 2 shows a detail of the structure shown in FIG. 1.

As diagrammatically indicated in FIG. 2, there is a variable voltage 20 across the pair of electrodes 14 and 15. This voltage is controlled by an information transmitting unit 21. The information transmitting unit 21 may be include conventional information storage media 22 and a controller 23 in the printing press.

For initiating a modification operation without halting the printing press current is applied to the electrodes 14 and 15 to produce a voltage 20 across them. Owing to the electric field becoming established between the linear tip 16 and the counter-electrode 14 the printing image carrier having this field acting through it is polarized, that is to say there will be a continuous hydrophilic zone 24. By means of a heat source 25 arranged after the electrode 15 in the direction of rotation of the printing image carrier cylinder 14 in the form of a ray source a dot beam 26 is directed towards the printing image carrier 13 so as to heat the specific dot shone upon above the Curie temperature of the respective ferroelectric material so that the same is depolarized or converted into a hydrophobic condition. It is in this manner that all the hydrophobic image areas 27, which are to accept ink, are produced. The ray source 25 is also controlled by the information transmitting unit 21 in such a manner that the ray source 25 is reciprocated in the length direction of the printing image carrier cylinder 14. The printing information from the system 22 is so interpreted that a ray is only generated where an image dot is to be produced. The modification operation may be reversed by turning the printing image carrier cylinder 14 in the reverse direction and by having the heat source in the form of a linear ray and the electrode in the form of a dot electrode. In such a case an already existing image pattern is deleted with the heat source by producing a continuous depolarized or hydrophobic zone on the printing image carrier while the hydrophilic zones are produced by suitable operation of the electrode pin.

Figure 3:
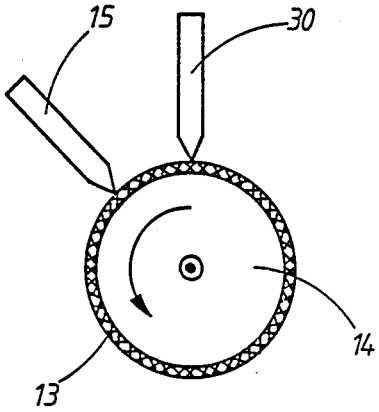
FIG. 3 shows a further working example of the invention.

FIG. 3 shows a form of the invention in which in lieu of a heat source there is a second electrode 30 cooperating with the first electrode 15 and the printing image carrier cylinder 14, functioning as the counter-electrode in order to carry out modifications. In this case the tip of the one electrode is in the form of a dot for the writing operation and the other is linear for the deletion operation. In this case the two electrodes 15 and 30 may be so operated that the deleting electrode continuously polarizes the ferroelectric layer, whereas the second, pin-like electrode is fed with a suitably high voltage for repolarizing so that hydrophilic zones are produced. Another possibility to produce hydrophilic image parts is the use of an RF ac voltage. The alternating field produced with such voltage causes the respective parts of the polarized ferroelectric layer to be depolarized.

It would also be possible to have the electrode 15 in FIG. 2 in the form of a dot in which case one would either have a row of dot electrodes or a single pin electrode. This simultaneously makes possible selective deletion. In the case of the embodiment of the invention shown in FIG. 3 the two electrodes 15 and 30 would be dot electrodes.

We claim:

1. A printing press comprising a printing image carrier having a printing image represented by hydrophilic and hydrophobic areas for surface printing, and means for modifying such areas, such printing image carrier having a material with ferroelectric properties, such modifying means being adapted to locally polarize and depolarize said printing image carrier.

2. The printing press as claimed in claim 1 wherein said printing image carrier is in the form of a foil of ferroelectric material.

3. The printing press as claimed in claim 1 wherein said printing image carrier comprises a coating of ferroelectric material.

4. The printing press as claimed in claim 1 wherein the printing image carrier consists of a composite material pervaded with ferroelectric crystals.

5. The printing press as claimed in claim 1 wherein said printing image carrier includes a layer applied to a printing image carrier support.

6. The printing press as claimed in claim 1 wherein the modifying means includes a pair of electrodes and a heat source, same be adapted to be operated by an information transmitting unit.

7. The printing press as claimed in claim 6 comprising a flat electrode with a linear electrode tip whose length is equal to the breadth of the printing image carrier, and a support for the printing image carrier, said support being in the form of a counter-electrode for cooperation with the electrode tip.

8. The printing press as claimed in claim 6 comprising a electrode extending to a tip and a support for the printing image carrier, said support being in the form of a counter-electrode for cooperation with the electrode tip.

9. The printing press as claimed in claim 6 wherein said heat source is adapted to produce a linear ray.

10. The printing machine as claimed in claim 9 comprising means for controlling the linear ray in a dot pattern.

11. The printing press as claimed in claim 6 wherein such heat source is adapted to produce a dot beam.

12. The printing press as claimed in claim 1 wherein such modifying means comprises electrodes adapted to be operated by information transmitting systems.

13. The printing press as claimed in claim 1 comprising means for feeding alternating current to the electrode.

14. The printing press as claimed in claim 1 wherein said printing image carrier comprises a ferroelectric layer and a thin layer of hydrophobic material applied thereto.

* * * * *